United States Patent [19]

Durst

[11] 4,135,666

[45] Jan. 23, 1979

[54] ARTIFICIAL CROSS-COUNTRY SKIING PRACTICE SET

[75] Inventor: Heinz Dürst, Leatherhead, England

[73] Assignee: Tacole Etablissement, Vaduz, Liechtenstein

[21] Appl. No.: 784,920

[22] Filed: Apr. 5, 1977

[30] Foreign Application Priority Data

Apr. 15, 1976 [CH] Switzerland ..... 4840/76

[51] Int. Cl.[2] ..... E01B 23/00; A63B 69/18

[52] U.S. Cl. ..... 238/10 R; 104/69; 104/134; 272/56.5 SS

[58] Field of Search ..... 272/56.5 R, 56.5 SS, 272/97, 70; 280/7.13, 8, 11.12, 11.1 BT, 11.2, 11.21; 104/134, 135, 136, 173 ST, 173 R, 53, 69, 60, 62; 238/1, 10 R, 10 A, 10 C

[56] References Cited

U.S. PATENT DOCUMENTS

| | | | |
|---|---|---|---|
| 892,758 | 7/1908 | McLay | 280/11.21 |
| 3,000,643 | 9/1961 | Levin | 280/11.2 |
| 3,363,583 | 1/1968 | Greenberg | 104/134 |
| 3,497,211 | 2/1970 | Nagin | 272/56.5 SS |
| 3,694,983 | 10/1972 | Couquet | 272/56.5 SS UX |
| 3,961,751 | 6/1976 | Kessler | 272/56.5 SS X |

FOREIGN PATENT DOCUMENTS

| | | | |
|---|---|---|---|
| 254011 | 5/1967 | Austria | 280/11.21 |
| 268958 | 2/1969 | Austria | 280/11.21 |
| 169739 | 8/1934 | Switzerland | 280/11.1 BT |

*Primary Examiner*—Richard C. Pinkham
*Assistant Examiner*—Arnold W. Kramer
*Attorney, Agent, or Firm*—Emory L. Groff, Jr.

[57] ABSTRACT

An artificial cross-country skiing practice set comprises a track formed of interfitted rail sections placed end-to-end to form parallel rolling bands receiving roller-ski members in normal skiing relationship. At least one roller of each ski member has an adjustable brake simulating resistance to advancement as when skiing on snow.

1 Claim, 3 Drawing Figures

ARTIFICIAL CROSS-COUNTRY SKIING PRACTICE SET

The invention relates to a set for practicing cross-country skiing when there is no snow.

The set according to the invention comprises an elongated track formed of elements adapted to be placed end-to-end on the ground, and at least one pair of ski-forming members provided with rollers and means for binding them to the feet of the person who desires to practice, at least one roller of each member having an adjustable brake exerting on the member a frictional force simulating resistance to advancement on snow.

The accompanying drawings show, schematically and by way of example, an embodiment of the invention. In the drawings.

Figure 1:
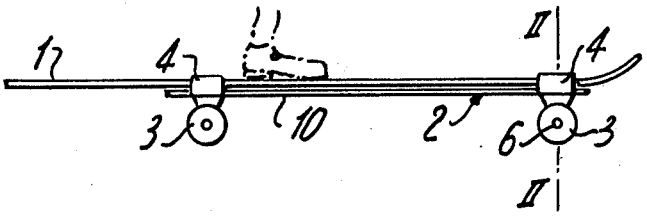
FIG. 1 shows a ski fitted with rollers.

The ski-forming member shown in the drawings comprises a cross-country ski 1 connected removably to a chassis 2 carried by four rollers 3 two of which are visible in FIG. 1. Chassis 2 comprises a metal plate 10 of U-section on which the ski 1 rests. The rollers 3 are fixed two by two on flanges 5 at each end of the plate 10. Substantially facing the rollers 3, bracket pieces 4 are welded to the chassis 2, these pieces 4 protruding two by two, facing one another, from the upper face of chassis 2 in a manner to hold the ski 1 against the chassis 2. The ski 1 is arranged with its pointed tip about 15 cm from one pair of pieces 4, the other pieces 4 being situated just behind the user's heel.

Figure 3:
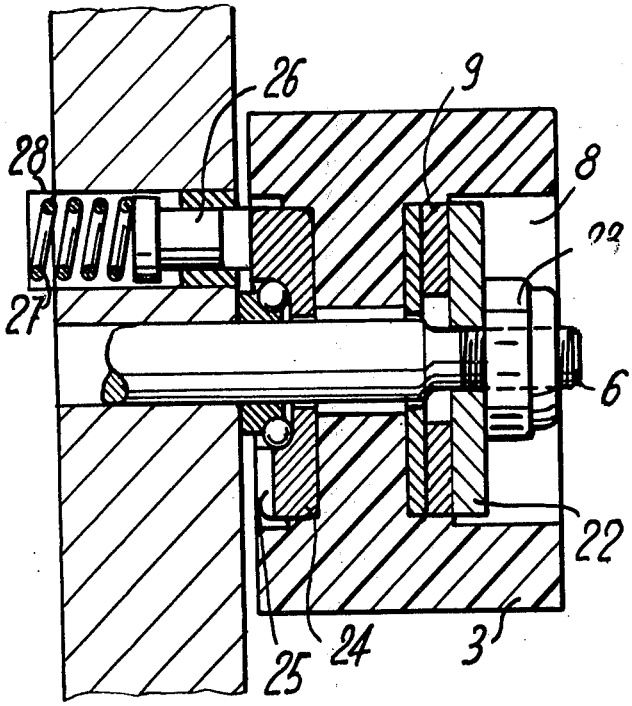
FIG. 3 is an axial cross-section of a roller with an adjustable brake.

One of the rollers 3 has a disc brake device shown in FIG. 3. This roller 3 has, on its outer surface, a cylindrical recess 8 receiving a brake lining 9 and a brake disc 22 which are engaged on an axle 6. The lining 9 is fixed to the roller 3 and the disc 22 is keyed on axle 6. The axle 6 has a threaded outer end for a nut 23 enabling setting of the axial position of the disc 22 to exert a greater or lesser pressure on the lining.

Hence, by more or less screwing the nut 23, one regulates the frictional force of the disc 22 on the lining 9 which simulates resistance to advancement as when skiing on snow.

The roller-ski member also includes a device enabling it to roll forwards only. FIG. 3 shows such a device comprising wheel 24 fixed on the axle 6, inside the roller 3, and having a saw-tooth toothing 25 cooperating with a pawl 26 which is biased against the wheel 24 by a spring 27 bearing against a bottom of a tube 28 fixed on the chassis 2 parallel to the roller axle 6.

Figure 2:
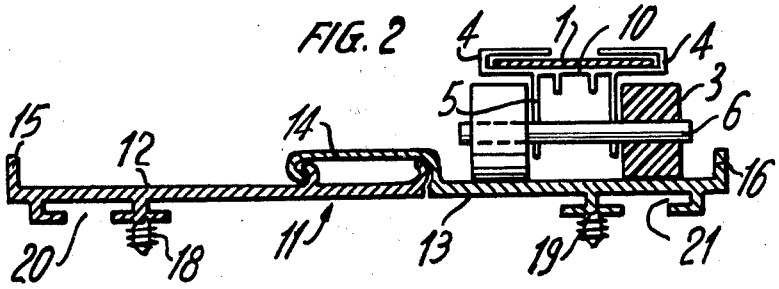
FIG. 2 is a cross-section along II—II of FIG. 1 with the rollers placed on a rail.

The set also comprises a track formed of profiled rails, for example of aluminium, these rails being placed directly on the ground along the desired trail. FIG. 2 shows a rail 11 comprising two interfitting longitudinal sections 12 and 13 having complementary press-fitted parts forming a central longitudinal guide rib 14 when the two sections are connected, as shown in FIG. 2. Each rail section 12, 13 also has a respective longitudinal external guide rib 15, 16. The rail sections have downwardly-protruding points 18, 19 which may be pressed into the soil to hold the assembled rail on the ground.

Longitudinal recesses 20, 21 are provided on the lower face of the rail sections for receiving joining plates (not shown) for connecting and holding the rails end-to-end.

One may thus prepare an artificial cross-country ski track on which a skier may practice in the same way as on the snow, the set enabling advancement in the same way as on snow.

In a variation of the roller-ski member, one may provide a brake on two rollers of each member or even on all the rollers.

I claim:

1. A two path track formed of shaped rails for guiding skis provided with wheels for praticing skiing out of season, each rail comprising two longitudinal sections, each section including top and bottom surfaces and inner and outer edges, a central wheel receiving portion bounded by a vertical longitudinally extending guide rib on its upper surface at the outer edge thereof and a longitudinally extending U-shaped portion at the opposite inner edge, the U-shaped portion of one section being offset from the plane of its wheel receiving portion and facing downwardly, the U-shaped portion of the other section facing upwardly and disposed in the same plane as its wheel receiving portion, the lower surface of each of said sections including integral downwardly projecting ground engaging members to anchor said sections in place, said lower surfaces also including longitudinally extending recessed areas adjacent the outer edge, means fitted in said recessed areas to connect and hold the rails end to end after said two longitudinal sections are connected to one another inner edge to inner edge by press-fitting said U-shaped portions together to provide said two path track.

* * * * *